US011186350B2

(12) United States Patent
Charles et al.

(10) Patent No.: US 11,186,350 B2
(45) Date of Patent: Nov. 30, 2021

(54) MAGNETIC DRIVE WITH REMOVABLE FINS AND WEIGHT BALANCE FOR AN UNMANNED UNDERSEA VEHICLE

(71) Applicant: L3Harris Technologies, Inc., Melbourne, FL (US)

(72) Inventors: David F. Charles, Arlington, VA (US); Jason D. Aiello, Fairhaven, MA (US)

(73) Assignee: L3HARRIS TECHNOLOGIES, INC., Melbourne, FL (US)

( * ) Notice: Subject to any disclaimer, the term of this patent is extended or adjusted under 35 U.S.C. 154(b) by 0 days.

(21) Appl. No.: 16/877,007

(22) Filed: May 18, 2020

(65) Prior Publication Data

US 2021/0016863 A1 Jan. 21, 2021

Related U.S. Application Data

(60) Provisional application No. 62/875,425, filed on Jul. 17, 2019.

(51) Int. Cl.

| | |
|---|---|
| ***B63G 8/00*** | (2006.01) |
| ***B63G 8/08*** | (2006.01) |
| ***B63G 8/18*** | (2006.01) |
| ***B63H 23/24*** | (2006.01) |

(52) U.S. Cl.

CPC ..... *B63G 8/001* (2013.01); *B63G 8/08* (2013.01); *B63G 8/18* (2013.01); *B63H 23/24* (2013.01); *B63G 2008/002* (2013.01)

(58) Field of Classification Search

CPC . B63G 8/00; B63G 8/001; B63G 8/08; B63G 8/18; B63H 23/00; B63H 23/24; B63H 20/00; B63H 20/007

USPC ..... 114/312

See application file for complete search history.

(56) References Cited

U.S. PATENT DOCUMENTS 3,361,215 A * 1/1968 Gayle ..... B63H 20/007 416/170 R

* cited by examiner

*Primary Examiner* — Lars A Olson

(74) *Attorney, Agent, or Firm* — Workman Nydegger

(57) ABSTRACT

An unmanned undersea vehicle including a magnetic coupler drive. The magnetic coupler drive is incorporated into a hull section, such as a tail section of the unmanned undersea vehicle. The magnetic coupler drive includes a motor shaft magnet, a titanium housing disposed about the motor shaft magnet, and a propeller shaft magnet magnetically coupled to the motor shaft magnet, but physically separated from the propeller shaft magnet by the titanium housing.

20 Claims, 5 Drawing Sheets

MAGNETIC DRIVE WITH REMOVABLE FINS AND WEIGHT BALANCE FOR AN UNMANNED UNDERSEA VEHICLE

CROSS-REFERENCE TO RELATED APPLICATIONS

This application claims the benefit of and priority to U.S. Provisional Patent Application Ser. No. 62/875,425 filed on Jul. 17, 2019 and entitled "MAGNETIC DRIVE WITH REMOVABLE FINS AND WEIGHT BALANCE FOR AN UNMANNED UNDERSEA VEHICLE," which application is expressly incorporated herein by reference in its entirety.

BACKGROUND

Background and Relevant Art

Unmanned undersea vehicles (also known as unmanned underwater vehicles, underwater drones, or UUVs) are vehicles that operate underwater without a human occupant. Typically, unmanned undersea vehicles are divided into two categories, remotely operated underwater vehicles (also known as ROVs), and autonomous underwater vehicles (also known as AUVs). Where the former is controlled by a remote human operator and the latter operates independently of human input.

Typically to navigate and maneuver through underwater terrain, unmanned undersea vehicles must supply power to drive motors and propellers. However, it can be appreciated that these vehicles will be operated in environments with varying levels of corrosiveness. Thus, it may be desirable to limit contact between drive motor components and corrosive liquids in which the vehicles will be operated.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

An unmanned undersea vehicle may include a magnetic coupler drive.

In one or more embodiments, the magnetic coupler drive is incorporated into a hull section, such as a tail section of the unmanned undersea vehicle. However, the magnetic coupler drive may, in other embodiments, be located within any number of sections in the unmanned undersea vehicle.

In one or more embodiments, the magnetic coupler drive includes a motor shaft magnet, a titanium housing disposed about the motor shaft magnet, and a propeller shaft magnet magnetically coupled to the motor shaft magnet, but physically separated from the propeller shaft magnet by the titanium housing.

Additional features and advantages of exemplary embodiments of the invention will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1A:
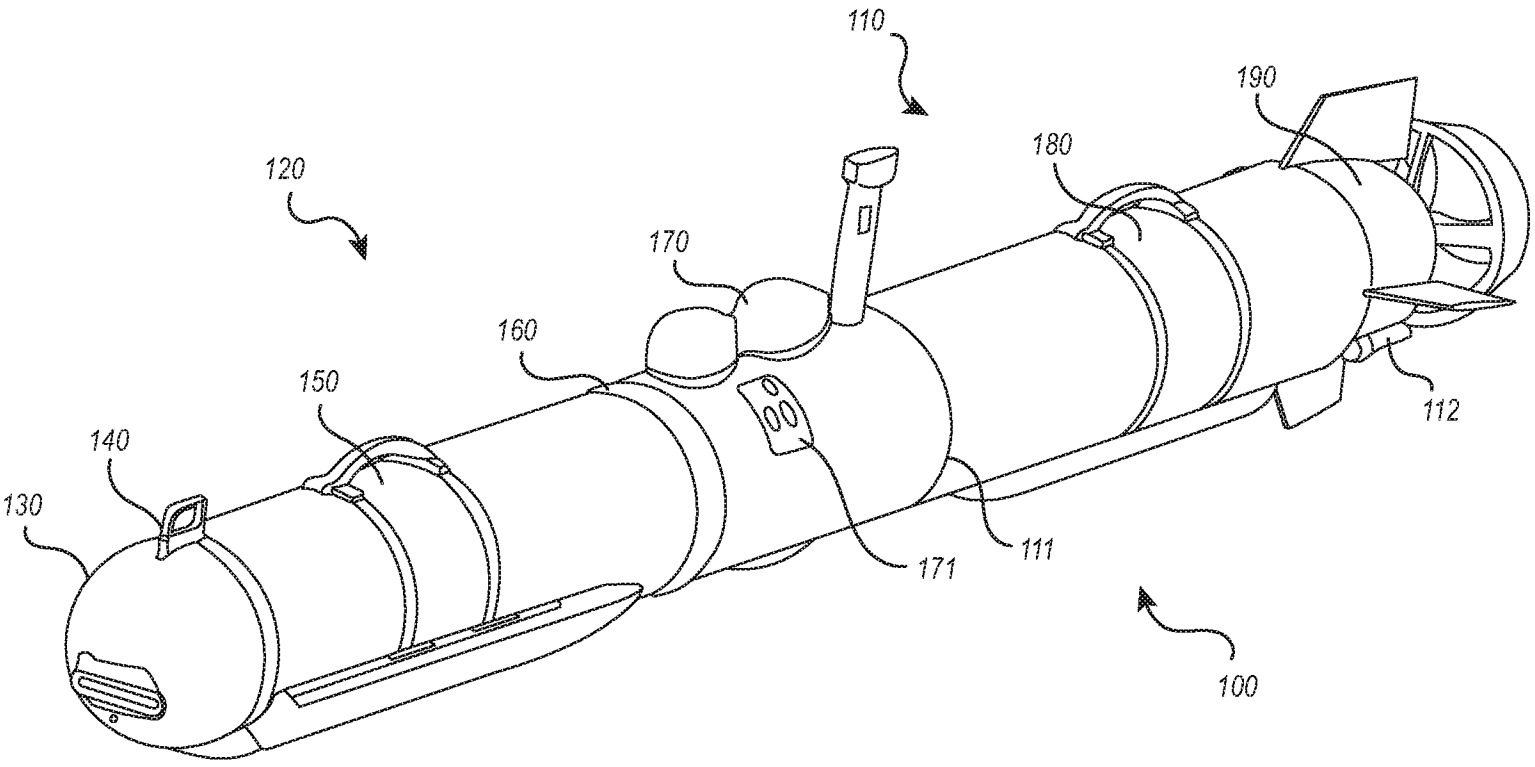
FIG. 1*a* illustrates a perspective view of an exemplary unmanned undersea vehicle.

The disclosed invention presents an innovative means to transmit power from drive motors to propellers to convert rotational motion to linear thrust to create the necessary propulsion for underwater navigation.

Embodiments disclosed herein comprise apparatuses, systems, components, and methods for unmanned undersea vehicles. These unmanned undersea vehicles can be used to carry payloads and software packages to detect, classify, localize, identify, and/or retrieve targets. In particular, disclosed embodiments may be designed to meet certain constraints. For example, in some embodiments, such unmanned undersea vehicles are designed to be less than 240 pounds, operate at 1000 feet below the surface of a body of water, be less than 99 inches in length, and/or be less than 9 inches in diameter. Indeed, in some embodiments, such unmanned undersea vehicles may be configured to be used in torpedo tubes of various watercraft.

Embodiments illustrated herein may include components that help to meet certain corrosion resistance requirements. Alternatively, or additionally, embodiments may include components configured to meet certain buoyancy requirements.

In addition to other features, the unmanned undersea vehicles illustrated herein include a magnetic coupler drive in its tail. The magnetic coupler drive is implemented in a fashion that isolates certain elements physically from other elements. In particular, embodiments are arranged in a fashion that physically isolates a propeller for the vehicle from the motor of the vehicle that drives the propeller. In particular, the vehicle will be implemented in a body of water or other corrosive liquid which may harm certain components of the vehicle. Thus, some embodiments are implemented to allow the propeller to be in contact with the liquid along with a shaft and bearing assembly coupled to the propeller to be in contact with the liquid. However, the motor used to drive the propeller and a motor shaft coupled to the motor are isolated by a housing from the liquid to prevent corrosion of the motor and motor shaft. The motor is nonetheless able to drive the propeller by using a set of magnets. In particular, one magnet is coupled to the motor shaft which is isolated from the liquid, while a different magnet is coupled to the propeller shaft where the propeller is not isolated from the liquid. A barrier is disposed between the motor shaft magnet and the propeller shaft magnet. For example, in some embodiments, a titanium housing is disposed about the motor shaft magnet and the propeller shaft magnet in a fashion that prevents any direct physical contact between the two. The titanium housing can be used to seal the motor from the environment external to the vehicle.

However, a magnetic coupling between the magnets remains. This is accomplished by careful selection of magnet sizes and strengths and housing dimensions. Magnet sizes and strengths and housing dimensions are typically selected based on characteristics of the drive motor. In particular, in the examples illustrated herein, the drive motor is selected to be about a 200 W (average power) motor. The motor shaft magnet and drive propeller shaft magnet illustrated herein are selected based on that motor power rating. Similarly, the housing illustrated herein is sized and shaped based on magnet strengths and motor power rating.

Figure 1B:
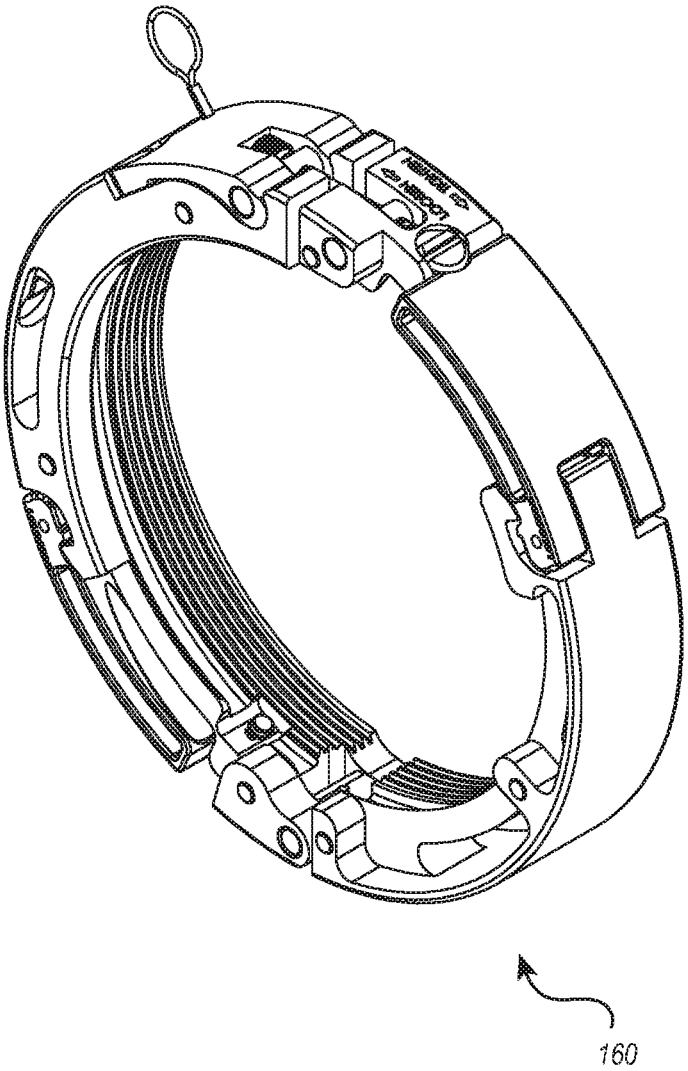
FIG. 1*b* illustrates a perspective view of an exemplary joiner clamp of FIG. 1*a;*
Figure 1C:
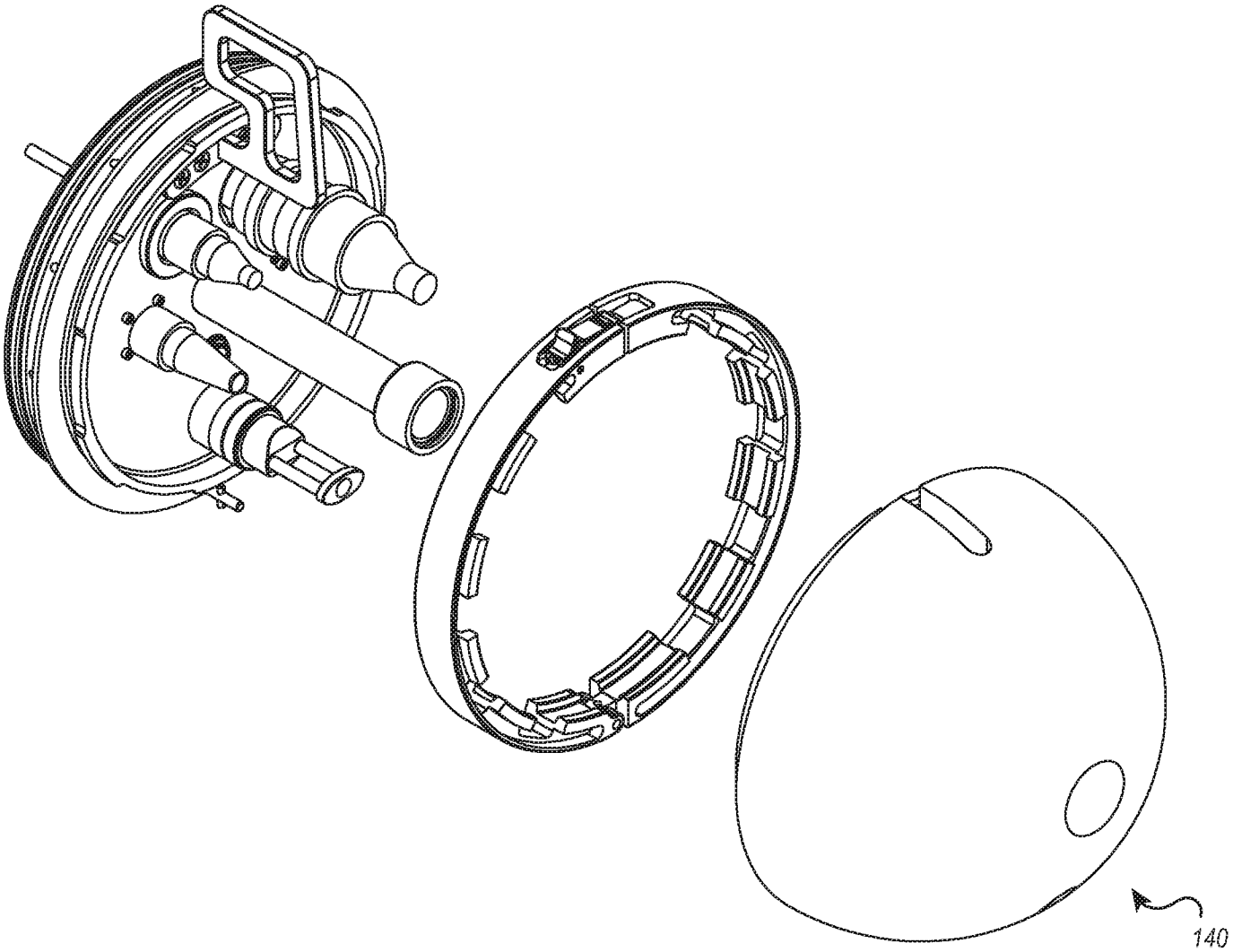
FIG. 1*c* illustrates a perspective view of an exemplary quick release bow clamp of FIG. 1*a;*
Figure 1D:
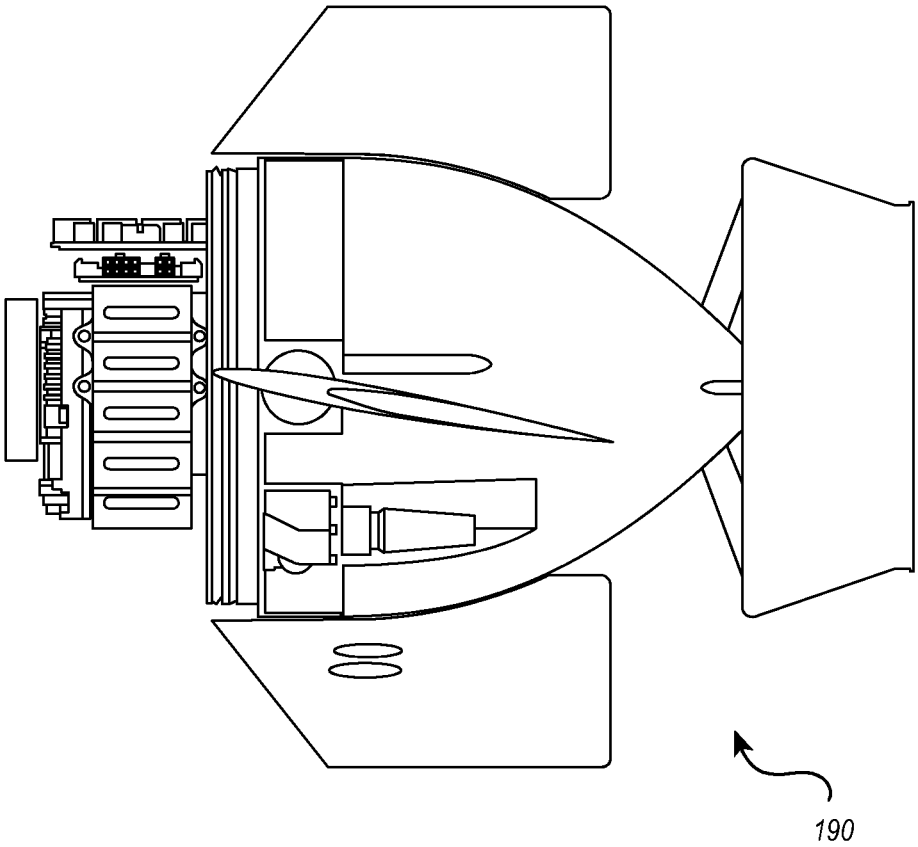
FIG. 1*d* illustrates a side view of an exemplary tail section of FIG. 1*a;*

FIG. 1*a* illustrates an exemplary underwater vehicle 100 that comprises various hull sections, including an aft section 110 and a forward section 120 (and/or various associated sub-sections) attached by a joiner clamp 160 (see FIG. 1*b*). In some embodiments, the forward section 120 may include a quick release bow clamp 140 (see FIG. 1*c*), thereby allowing section 130 to be completely or partially removed from section 150. Alternatively, or additionally, the aft section 110 may include a tail section 190 (see FIG. 1*d*) and/or a data crypt 171. The aft section 110 may be completely or partially separated into smaller components at junctions 111 and 112, thereby allowing section 170 to be completely or partially separated from section 180, and alternatively, or additionally, allowing section 180 to be completely or partially separated from the tail section 190.

Figure 2A:
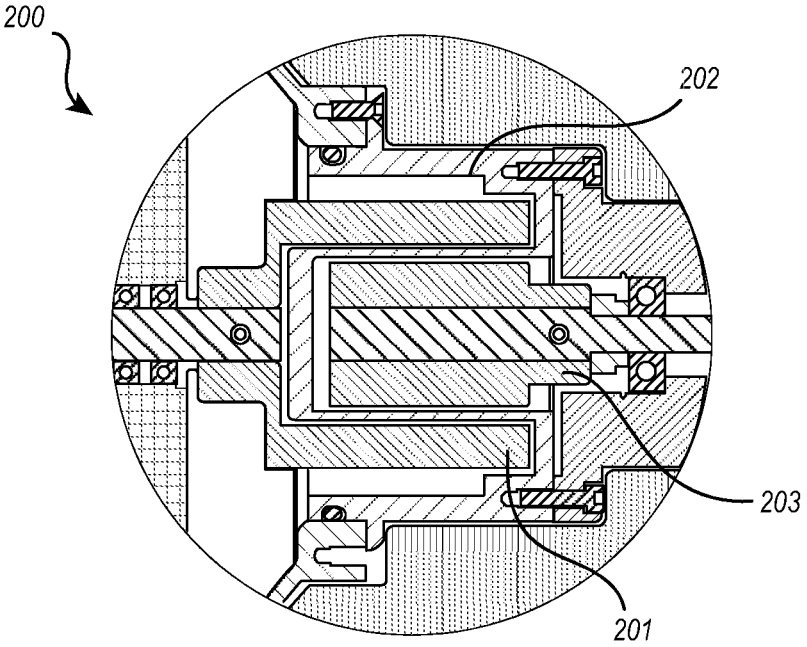
FIG. 2*a* illustrates an exemplary magnetic coupler drive.
Figure 2B:
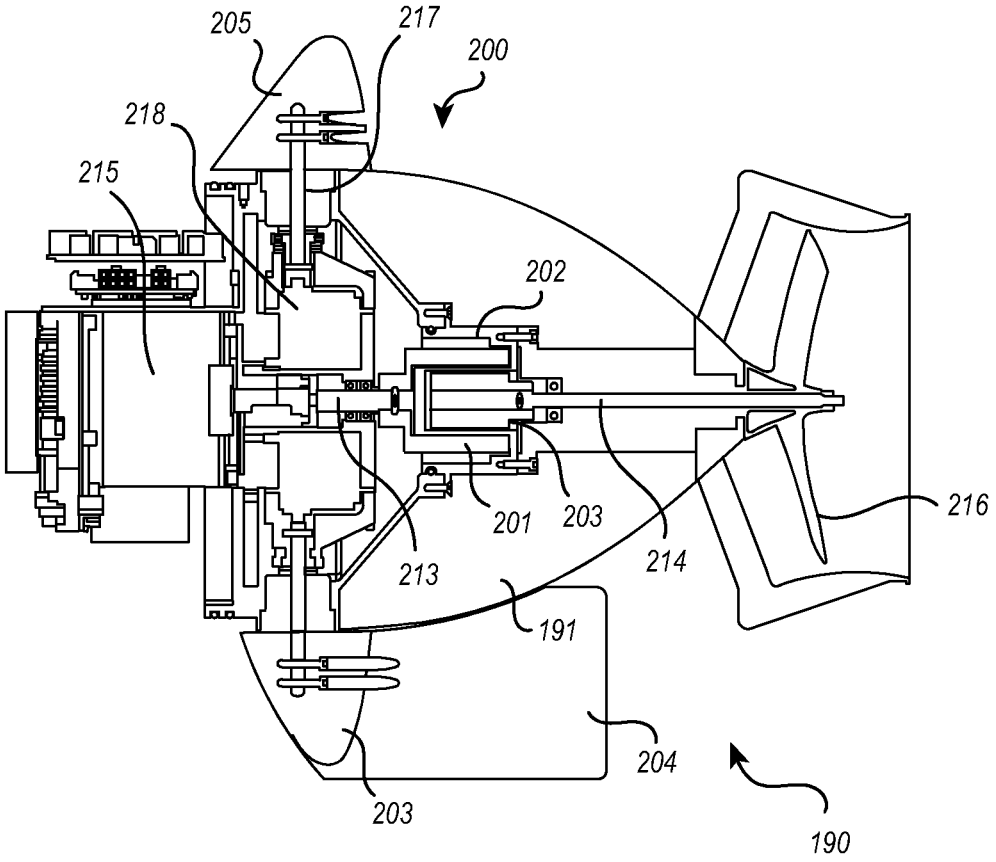
FIG. 2*b* illustrates a cut-away view of a magnetic coupler drive of FIG. 2*a* located within a tail section of FIG. 1*d*.

As shown in FIG. 2*a* and FIG. 2*b*, some embodiments of the underwater vehicle 100 include a magnetic drive 200 in the tail of the underwater vehicle 100. The magnetic drive 200 includes a motor shaft magnet 201 coupled to a motor shaft 213 of a motor 215, a titanium housing 202 disposed about the motor shaft magnet, and a propeller shaft magnet 203 coupled to a propeller shaft 214, coupled to a propeller 216.

Figure 2C:
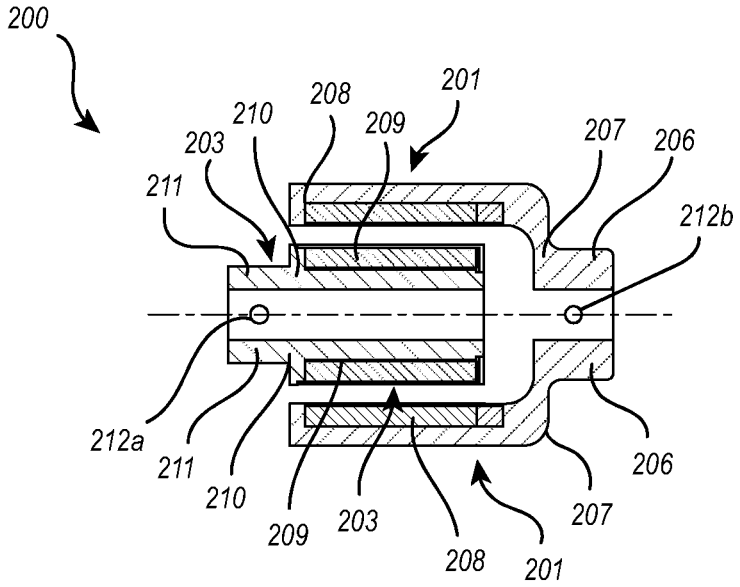
FIG. 2*c* illustrates a cross sectional view of a magnetic coupler drive of FIG. 2*a*.

In some embodiments, the magnetic drive 200 is coupled to a 200-Watt motor. To function efficiently the components of the magnetic drive 200 are sized appropriately based on the use of a 200-Watt motor. FIG. 2*c* shows a cross sectional area of one embodiment of the appropriately sized components of the magnetic drive 200 when used with a 200-Watt motor.

One embodiment of the motor shaft magnet 201 may, for example, include a neck 206, a shoulder 207, and a body 208. In particular, the neck 206 may have a length of approximately 0.63 inches, and an outer diameter of approximately 1.02 inches. Additionally, or alternatively, the body 208 may have a length of approximately 1.90 inches, an inner diameter of approximately 1.378 inches, and an outer diameter of approximately 2.05 inches. Additionally, or alternatively, the neck 206 and the body 208 may be joined at the shoulder 207, giving the motor shaft magnet 201 a combined length of approximately 2.53 inches.

One embodiment of the propeller shaft magnet 203 may, for example, include a neck 211, a shoulder 210, and a body 209. In particular, the neck 211 may have a length of approximately 0.47 inches, and an outer diameter of approximately 0.75 inches. Additionally, or alternatively, the body 209 may have a length of approximately 1.52 inches, and an outer diameter of approximately 1.102 inches. Additionally, or alternatively, the neck 211 and the body 209 may be joined at the shoulder 210, giving the propeller shaft magnet 203 a combined length of approximately 1.99 inches.

One embodiment of the magnetic drive 200 may include, for example, the propeller shaft magnet 203 located at least partially within the motor shaft magnet 201 (although physically separated), wherein the outer diameter of the body 209 is approximately equidistance at all points from the inner diameter of the body 208. In some embodiments, for the magnetic drive 200 to function efficiently, the distance between the motor shaft magnet 201 and the propeller shaft magnet 203 is approximately 0.375 inches. That is, the distance between the neck 206 and the body 209 is, in some embodiments, approximately 0.375 inches. In other words, the distance from the shoulder 210 to the neck 206 is approximately 1.90 inches. In other embodiments, in inner diameter of the neck 206 and the inner diameter of the neck 211 are approximately equal.

In some embodiments of the magnetic drive 200, the motor shaft magnet 201 may include a pin hole 212*b*. Additionally, or alternatively, the propeller shaft magnet 203 may include a pin hole 212*a*. Particularly, the pin holes 212*a* and *b* have a diameter within the range of at least approximately 0.124 inches and at least approximately 0.129 inches. In one embodiment, the pin hole 212*b* is at least approximately 0.31 inches from the end of the neck 206. Additionally, or alternatively, the pin hole 212*a* is at least approximately 0.31 inches from the end of the neck 211. The pin holes 212*a* and 212*b* may be used to receive a fastener for connecting the magnets to the corresponding shafts 213 and 213.

It should be appreciated that the described dimensional embodiments are to be considered in all respects only as illustrative and not restrictive. Thus, the magnetic drive 200 may be appropriately sized through a number of other embodiments and variations.

In some embodiments, the size of the magnets used for the motor shaft magnet 201 and the propeller shaft magnet 203 may vary. For example, in one embodiment, increasing the size of the magnets may have the effect of increasing the power output capable for the magnetic drive 200. That is, higher power motors can be used for the magnetic drive.

Returning once again to FIG. 2*b*, the tail section 190 further includes a number of fins 204. In some embodiments, the tail section 190 includes four fins 204. However, in other embodiments, the tail section 190 may include more than four fins 204 or fewer than four fins 204. Notably, the fins 204 in the examples illustrated are removable. In particular, use of the underwater vehicle 100 may result in the fins 204 being broken due to impacts, operational stresses, or for other reasons. In the example illustrated, the fins 204 are attached by sliding the fins 204 on to a protruding member 205 and then fastening the fins 204 using screws through a hole portion of the fins 204 into the protruding member 205.

In some embodiments, the tail section 190 may include, for example, fins 204 of similar size, dimensional ratio, material, and weight. In other embodiments, the tail section 190 may include, for example, fins 204 of different size, dimensional ratio, material, and weight. Further, a particular combination of the fins 204 may improve, for example, the buoyancy of the underwater vehicle 100, the maximum speed of the underwater vehicle 100, the maneuverability of the underwater vehicle 100, or other enhancing features. Due to the unique removable aspect of the fins 204, a user may selectively determine the best combination of fins 204 for a particular mission.

As noted above, the fins 204 are attached to protruding members 205. One or more of the protruding members 205 are coupled to rotational shafts 217, which are in turn coupled to solenoids 218. The solenoids 218 can be controlled to control lateral orientations of the rotational shafts 217 and thus the orientations of the protruding members 205 and fins 204. This can be used to control direction of the vehicle and/or climbing or diving of the vehicle.

Note that the protruding members 205 are configured in size and shape to engage securely with mating cavities in the fins 204.

The tail section 190 further includes a foam shell 191 about portions of the tail section 190. In some embodiments, the foam shell 191 is constructed for weight savings and buoyancy. For example, in one embodiment the foam shell 191 is positively buoyant. Further, the foam shell 191 can be constructed of syntactic foam, which comprises hollow glass balls suspended in urethane. In other embodiments, the tail section 190 may include a foam shell 191 about portions of the tail section 190, wherein the foam shell 191 is constructed of any material with positively buoyant features.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An underwater vehicle comprising:

a hull section, wherein the hull section further comprises:

a motor, wherein the motor comprises a motor shaft;

a motor shaft magnet coupled to the motor shaft;

a housing disposed about the motor shaft magnet, the housing configured to prevent direct physical contact between the motor shaft magnet and a propeller shaft magnet, but sized and shaped based on magnet strengths of the motor shaft magnet and the propeller shaft magnet to allow for a magnetic coupling to exist between the motor shaft magnet and the propeller shaft magnet;

the propeller shaft magnet magnetically coupled to the motor shaft magnet, the propeller shaft magnet being at least partially within the motor shaft magnet and being spaced from the motor shaft magnet;

a propeller shaft coupled to the propeller shaft magnet; and a propeller coupled to the propeller shaft.

2. The underwater vehicle of claim 1, wherein the motor is a 200-Watt motor.

3. The underwater vehicle of claim 1, wherein the housing disposed about the motor shaft magnet is comprised of titanium.

4. The underwater vehicle of claim 1, wherein a distance between the motor shaft magnet and the propeller shaft magnet is at least approximately ⅜ inches.

5. The underwater vehicle of claim 1, further comprising a tail section and the tail section comprises a plurality of fins.

6. The underwater vehicle of claim 5, wherein at least one of the plurality of fins is attached to a protruding member.

7. The underwater vehicle of claim 5, wherein at least one of the plurality of fins is selectively attachable to a protruding member.

8. The underwater vehicle of claim 1, further comprising a tail section wherein the tail section comprises a foam shell.

9. The underwater vehicle of claim 8, wherein the foam shell is positively buoyant.

10. The underwater vehicle of claim 8, wherein the foam shell is constructed of syntactic foam, which comprises hollow glass balls suspended in urethane.

11. The underwater vehicle of claim 1, further comprising a tail section wherein at least a part of the tail section is configured to be selectively attached to at least one section of the underwater vehicle.

12. A method of making a drive system in an underwater vehicle, the method comprising:

coupling a motor shaft magnet to a motor shaft of a motor;

disposing a housing about the motor shaft magnet, the housing configured to prevent direct physical contact between the motor shaft magnet and a propeller shaft magnet, but sized and shaped based on magnet strengths of the motor shaft magnet and the propeller shaft magnet to allow for a magnetic coupling to exist between the motor shaft magnet and the propeller shaft magnet, the propeller shaft magnet being at least partially within the motor shaft magnet and being spaced from the motor shaft magnet;

magnetically coupling the propeller shaft magnet to the motor shaft magnet;

coupling a propeller shaft to the propeller shaft magnet; and coupling a propeller to the propeller shaft.

13. The method of claim 12, wherein the motor is a 200-Watt motor.

14. The method of claim 12, wherein the housing disposed about the motor shaft magnet is comprised of titanium.

15. The method of claim 12, wherein a distance between the motor shaft magnet and the propeller shaft magnet is at least approximately ⅜ inches.

16. The method of claim 12, further comprising disposing the drive system in a tail section and coupling a plurality of user selectively removeable fins to protruding members of the tail section.

17. A method of using a drive system in an underwater vehicle, the method comprising:

driving a motor having a motor shaft coupled to a motor shaft magnet, wherein the motor shaft magnet is disposed in a housing about the motor shaft magnet, the housing configured to prevent direct physical contact between the motor shaft magnet and a propeller shaft magnet, but sized and shaped based on magnet strengths of the motor shaft magnet and the propeller shaft magnet to allow for a magnetic coupling to exist between the motor shaft magnet and the propeller shaft magnet, the propeller shaft magnet being at least partially within the motor shaft magnet and being spaced from the motor shaft magnet; and as a result of driving the motor and a magnetic coupling between the propeller shaft magnet to the motor shaft magnet, driving a propeller shaft coupled to a propeller.

18. The method of claim 17, wherein the motor is a 200-Watt motor.

19. The method of claim 17, wherein the housing disposed about the motor shaft magnet is comprised of titanium.

20. The method of claim 17, wherein a distance between the motor shaft magnet and the propeller shaft magnet is at least approximately ⅜ inches.

* * * * *